US011731192B1

(12) United States Patent
Thrasher

(10) Patent No.: US 11,731,192 B1
(45) Date of Patent: Aug. 22, 2023

(54) VACUUM-ASSISTED DIE CASTING APPARATUS

(71) Applicant: Exco Technologies Limited, Markham (CA)

(72) Inventor: Jeffrey William Thrasher, Markham (CA)

(73) Assignee: Exco Technologies Limited, Markham (CA)

( * ) Notice: Subject to any disclaimer, the term of this patent is extended or adjusted under 35 U.S.C. 154(b) by 0 days.

(21) Appl. No.: 18/103,044

(22) Filed: Jan. 30, 2023

(51) Int. Cl.
*B22D 18/06* (2006.01)

(52) U.S. Cl.
CPC ..... *B22D 18/06* (2013.01)

(58) Field of Classification Search
CPC ..... B22D 18/06; B22D 17/00; B22D 17/002; B22D 17/02; B22D 17/04; B22D 17/14; B22D 17/145; B22D 17/229; B22D 17/26; B22D 17/263; B22D 17/266
See application file for complete search history.

(56) References Cited

U.S. PATENT DOCUMENTS 5,323,840 A * 6/1994 Usui ..... B22D 19/0009 164/332

* cited by examiner

*Primary Examiner* — Kevin P Kerns
*Assistant Examiner* — Steven S Ha

(57) ABSTRACT

A die assembly for a vacuum assisted die casting apparatus includes: a cover die half supporting a cover die, the cover die having a first chill vent surface; a moveable ejector die half supporting an ejector die, the ejector die half being configured to be moved along a first axis; and a moveable slide die supported by the ejector die. The slide die is configured to be moved along a second axis perpendicular to the first axis, the slide die having a second chill vent surface.

16 Claims, 9 Drawing Sheets

VACUUM-ASSISTED DIE CASTING APPARATUS

FIELD

The subject disclosure relates generally to die casting and in particular, to a vacuum-assisted die casting apparatus.

BACKGROUND

In the field of automotive manufacturing, structural components that historically have been fabricated of steel, such as engine cradles, are increasingly being replaced with aluminum alloy castings. Such castings are typically large, convoluted, and relatively thin, and are required to meet the high quality standards of automotive manufacturing. In order to meet these requirements, vacuum-assisted die casting is typically used to produce such castings.

Vacuum-assisted die casting machines comprise two opposing main dies, namely a movable ejector die and a fixed cover die, that define a mold cavity. A piston, sometimes referred to as a "plunger", is advanced through a piston bore of a shot sleeve to push a volume of liquid metal into the mold cavity. Vacuum is applied to the mold cavity via vacuum ports to remove air therefrom.

As vacuum assisted die casting technology evolves, there is a trend toward replacing traditional mechanically-activated or hydraulically-activated vacuum valves with a vacuum over chill vent (VOCV) arrangement. In the VOCV arrangement, chill vent surfaces are positioned on each main die adjacent to the vacuum ports. The chill vent surfaces passively provide a large surface area for solidifying liquid metal flowing therethrough, so as to prevent liquid metal from otherwise exiting the mold cavity.

Vacuum-assisted die casting apparatuses having chill vents have been described. For example, U.S. Pat. No. 7,770,627 to Wang et al. describes a vent assembly for a high pressure die casting system including a pair of opposed chill blocks having corresponding chill surfaces defining a continuous vent chamber therebetween, each of the chill surfaces comprising a plurality of adjoining chill faces extending the length of the vent chamber, each chill face having a corresponding chill face on the paired chill block defining a section of the vent chamber, the plane of each chill face being oriented at an angle to an adjoining chill face on the corresponding block. The chill face on a chill block is preferably substantially equidistant from the chill face of the corresponding chill block defining the respective section of the vent chamber.

Korean Patent Document No. 102037257 to Lee discloses a vacuum die casting apparatus comprising: a fixing mold; a moving mold moving to adhere to the fixing mold or to be separated from the fixing mold, and forming a cavity having a casting product shape; and a plurality of chill vent portions arranged between the fixing mold and the moving mold and provided with an uneven hollow. A plurality of overflow chambers in which a fluid is fluidly connected to the cavity and the chill vent portions for molten metal overflowing from the cavity to be introduced and for remaining gas to be discharged from the chill vent portions from the cavity, and one vacuum runner in which the chill vent portions and the fluid are fluidly connected to each other to discharge the remaining gas introduced from the cavity to the outside, are formed between the fixing mold and the moving mold.

Vacuum-assisted die casting chill vent surfaces are available for purchase as generic chill vent die inserts from die casting equipment suppliers. However, owing to their generic nature, the generic chill vent die inserts have geometries that create undercut conditions in all die pull directions, other than the main pull direction of the ejector die from the cover die. For this reason, the generic chill vent components cannot be positioned on slide dies without also providing an accompanying ejector system, which would otherwise add a significant degree of mechanical complexity. As a result, the generic chill vent components are instead typically positioned at the upper corners of each main die surface. However, because the seal at the parting line defined between the two opposing main dies gradually worsens after successive cycles of a given production run, due to greater thermal expansion experienced by the slide dies relative to the opposing main dies, positioning the chill vent surfaces at these positions results in unacceptable flashing at the parting line.

To avoid such flashing, it would be necessary to position the chill vent surfaces on a portion of the die experiencing greater relative thermal expansion during operation, such as on one of the slide dies. However, due to their generic, undercutting geometry, locating the chill vents on a slide die would require an accompanying ejector system to be built into the slide die. This additional ejection system would require moving parts, which would ultimately necessitate additional maintenance downtime that was otherwise being avoided by using VOCV arrangement instead of the traditional mechanically-activated or hydraulically-activated vacuum valves, thereby negating most of the advantages provided by the VOCV arrangement.

Improvements are generally desired. It is therefore an object at least to provide a novel vacuum-assisted die casting apparatus.

SUMMARY

There is a need for a VOCV arrangement that can be located on a slide die, and not in the upper corners of the opposing main dies, so that a better seal is provided, where the seal around the chill vent actually improves as the die heats up and the slide tips grow by thermal expansion, and in turn space apart the upper corners of the opposing main dies.

There is also a need for a VOCV arrangement that is entirely open to both slide draw direction on one side and main die draw direction on another side. This advantageously avoids the need for a mechanical ejection system containing moving parts to be built into the slide die, which would otherwise be required to lift the corrugated geometry of the casting off of the corrugated chill vent surface to allow the slide die to retract without i) breaking the corrugated portion off of the remainder of the casting and/or ii) having it stick to the surface of the slide and thereby block airflow for the next casting cycle.

There is also a need for a VOCV arrangement that provides tightly spaced, deep corrugations that greatly increase the ratio of flow length to the projected area of the chill vent.

There is also a need for a VOCV arrangement that provides increased width and sufficient adjacent sealing surfaces within the limited spatial constraints of a slide die.

There is also a need for a VOCV arrangement that results in a lower total projected area of the overall die surface, as compared to die surfaces having chill vents placed in the upper corners of the opposing main dies.

Accordingly, in one aspect there is provided a die assembly for a vacuum assisted die casting apparatus, the die assembly comprising: a cover die half supporting a cover die, the cover die having a first chill vent surface; a moveable ejector die half supporting an ejector die, the ejector die half being configured to be moved along a first axis; and a moveable slide die supported by the ejector die, the slide die being configured to be moved along a second axis perpendicular to the first axis, the slide die having a second chill vent surface.

The first chill vent surface may define a plurality of parallel, first elongate features, and the second chill vent surface may define a plurality of parallel, second elongate features, and the first elongate features are parallel to the second elongate features. The first elongate features and the second elongate features may extend in a direction that lies within a plane defined by the first axis and the second axis.

The first chill vent surface may comprise a first corrugated surface, and the second chill vent surface may comprise a second corrugated surface. The first corrugated surface may comprise a plurality of first corrugations, and the second corrugated surface may comprise a plurality of second corrugations, the first corrugations being parallel to the second corrugations. The first corrugations and the second corrugations may extend in a direction that lies within a plane defined by the first axis and the second axis.

The first corrugations may comprise a plurality of crests and troughs that alternate periodically. The crests and troughs may alternate sinusoidally.

The second corrugations may comprise a plurality of crests and troughs that alternate periodically. The crests and troughs may alternate sinusoidally.

The first chill vent surface may comprise an inclined tab shaped to pull and detach the casting from the second chill vent surface when the moveable ejector die half is drawn along the first axis. The inclined tab may have an inclined surface defining an inclination plane, said direction that lies within the plane defined by the first axis and the second axis also lying within the inclination plane.

The direction may define an angle with the second axis of between 0.1 and 20 degrees.

BRIEF DESCRIPTION OF THE DRAWINGS

Embodiments will now be described more fully with reference to the accompanying drawings in which.

DETAILED DESCRIPTION OF EMBODIMENTS

Figure 1:
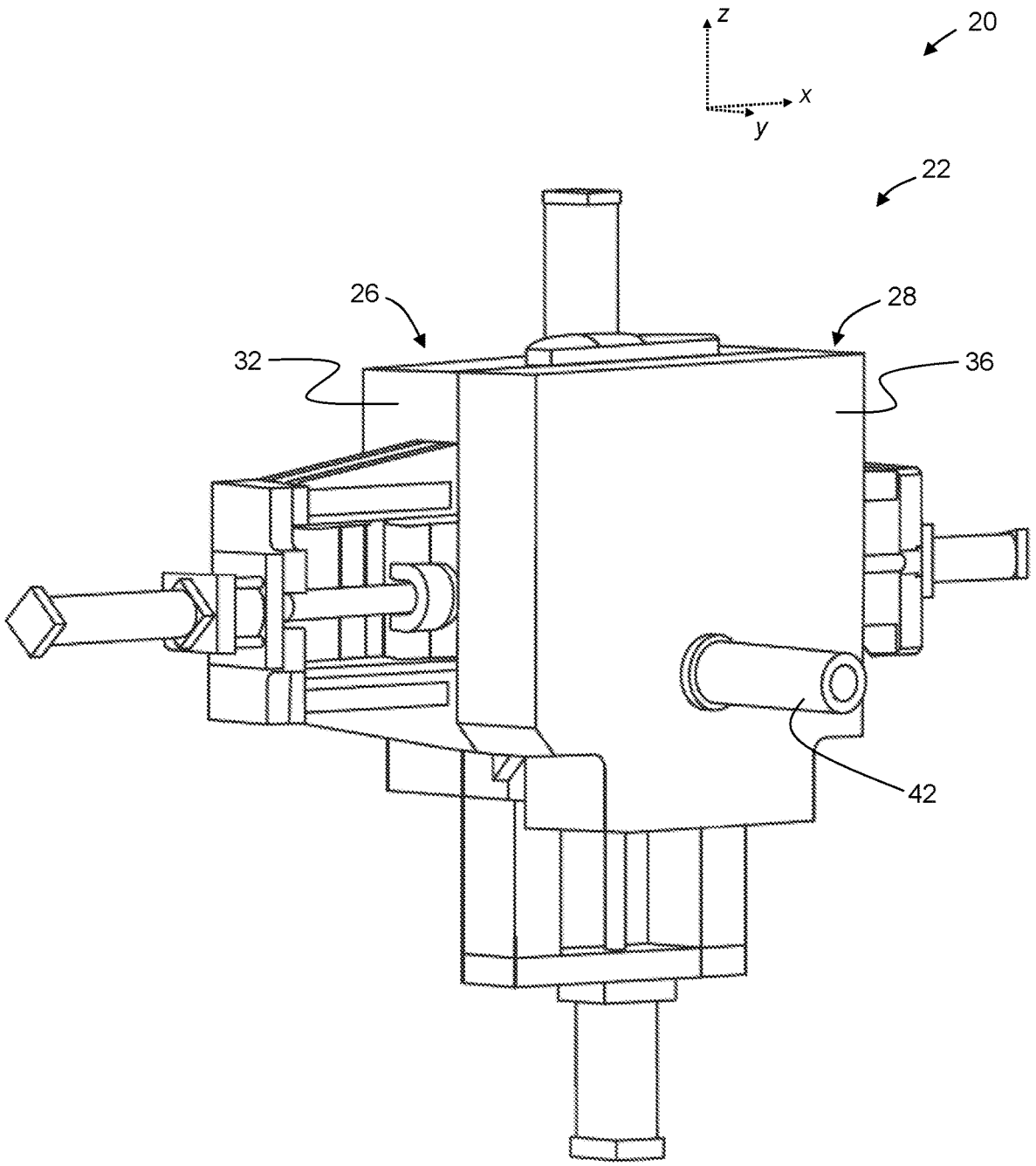
FIG. 1 is a perspective view of a portion of a vacuum-assisted die casting apparatus, comprising a die assembly.
Figure 2:
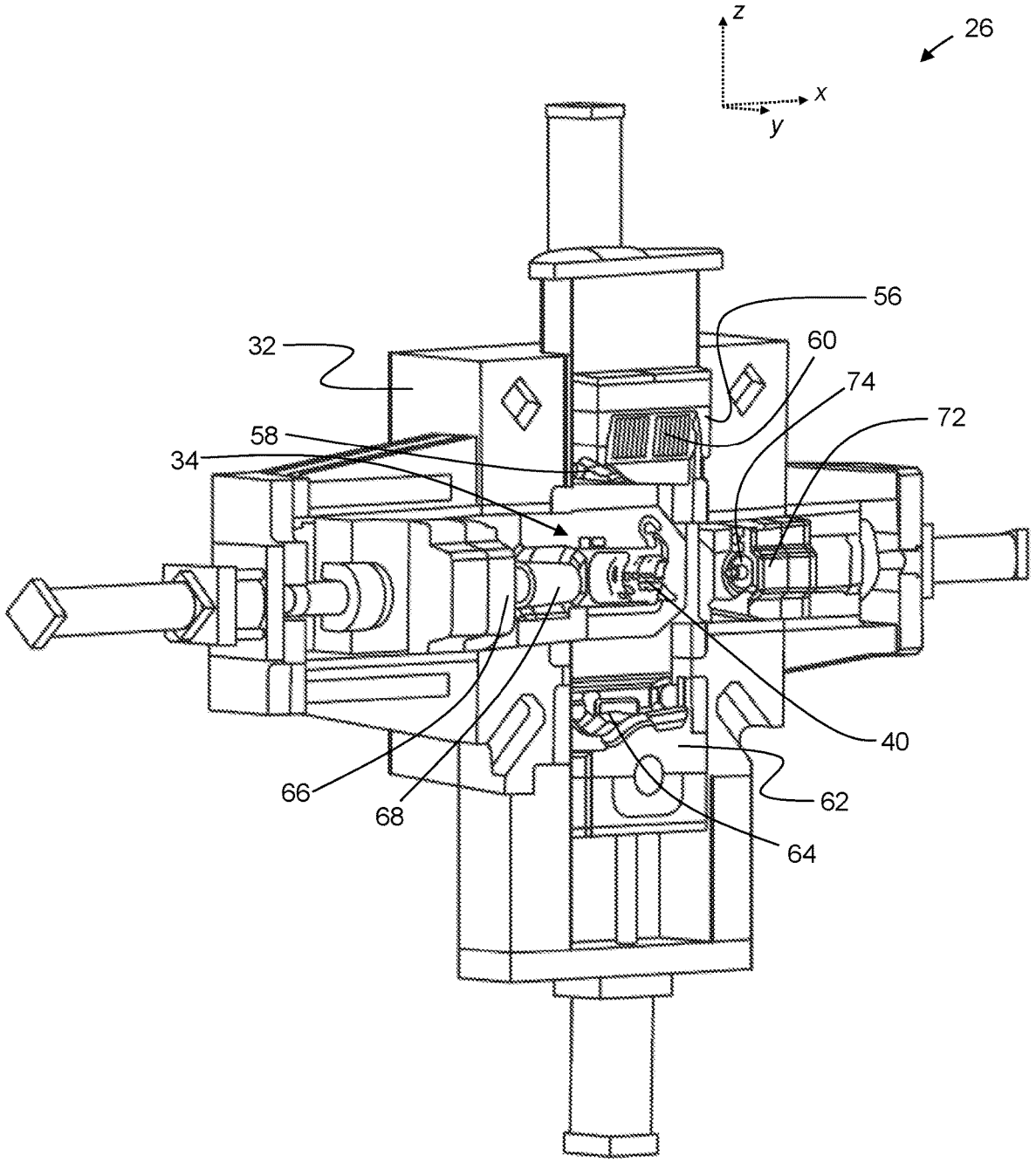
FIG. 2 is a perspective view of an ejector die half forming part of the die assembly of FIG. 1, in an open configuration.
Figure 3:
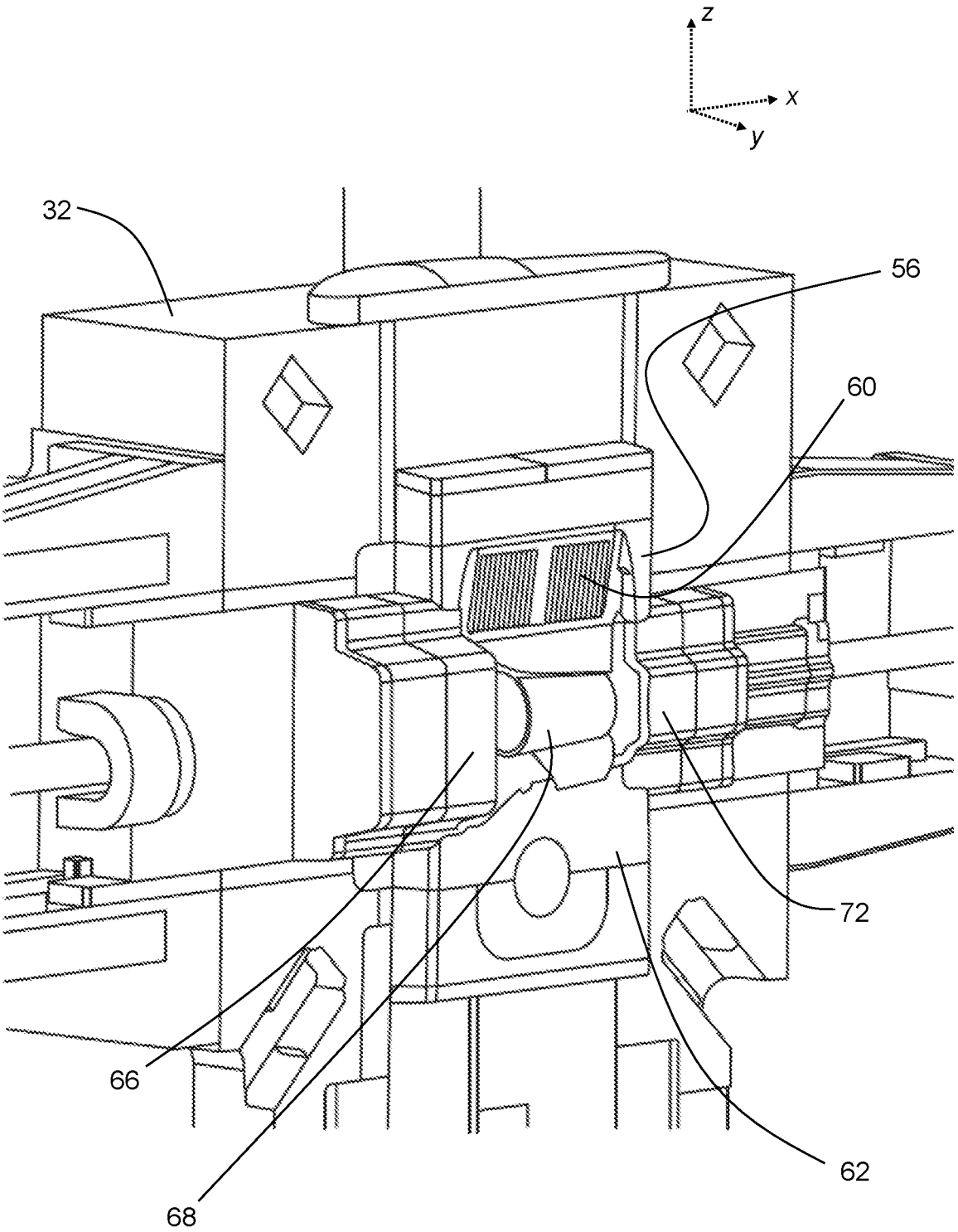
FIG. 3 is an enlarged fragmentary view of a portion of the ejector die half of FIG. 2, in a closed configuration.
Figure 4:
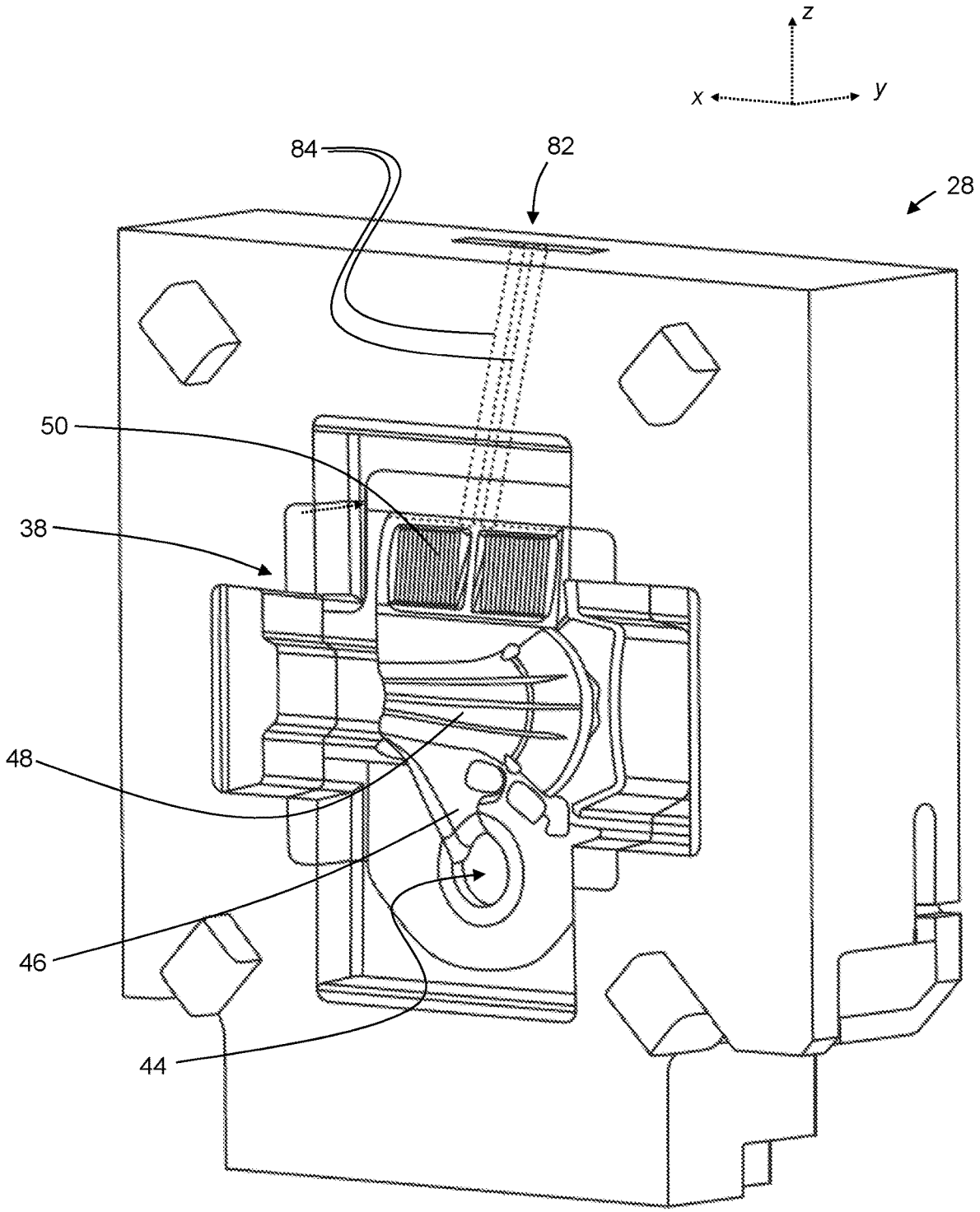
FIG. 4 is a perspective view of a cover die half forming part of the die assembly of FIG. 1.
Figure 5:
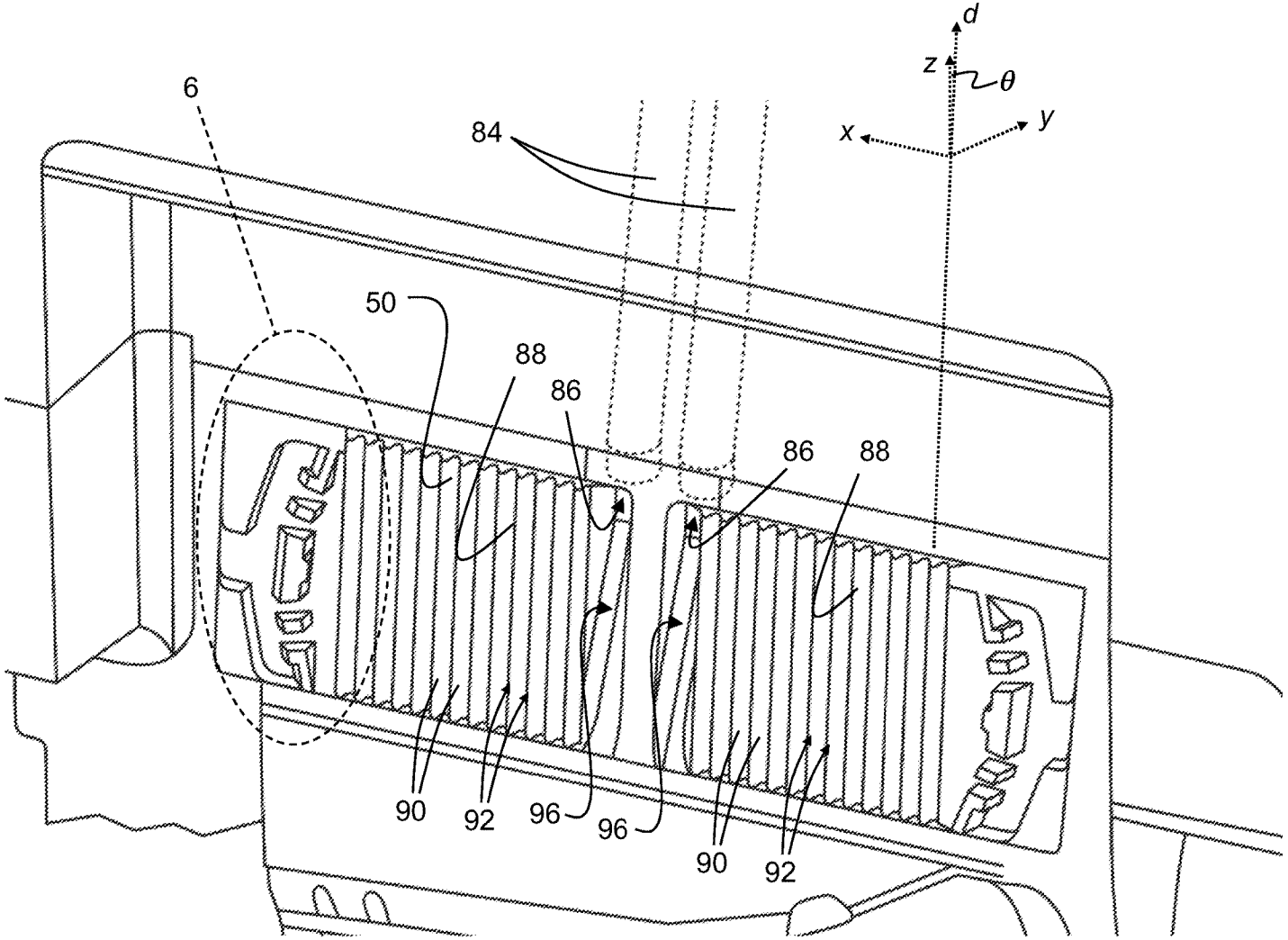
FIG. 5 is an enlarged fragmentary view of a portion of the cover die half of FIG. 4.
Figure 7:
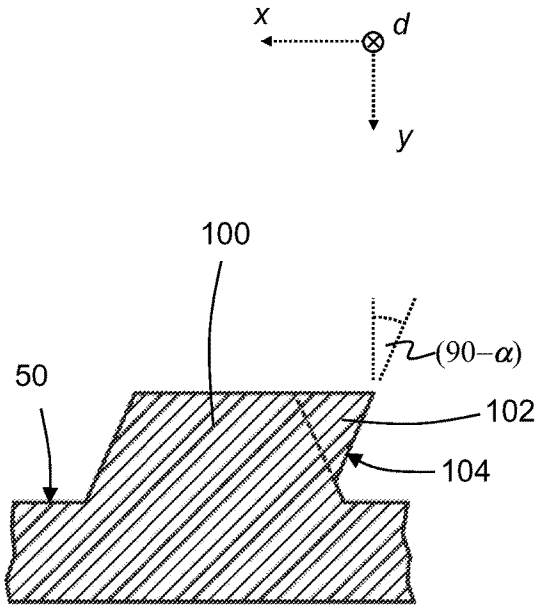
FIG. 7 is a sectional view of the cover die half of FIG. 6, taken along the indicated section line.
Figure 6:
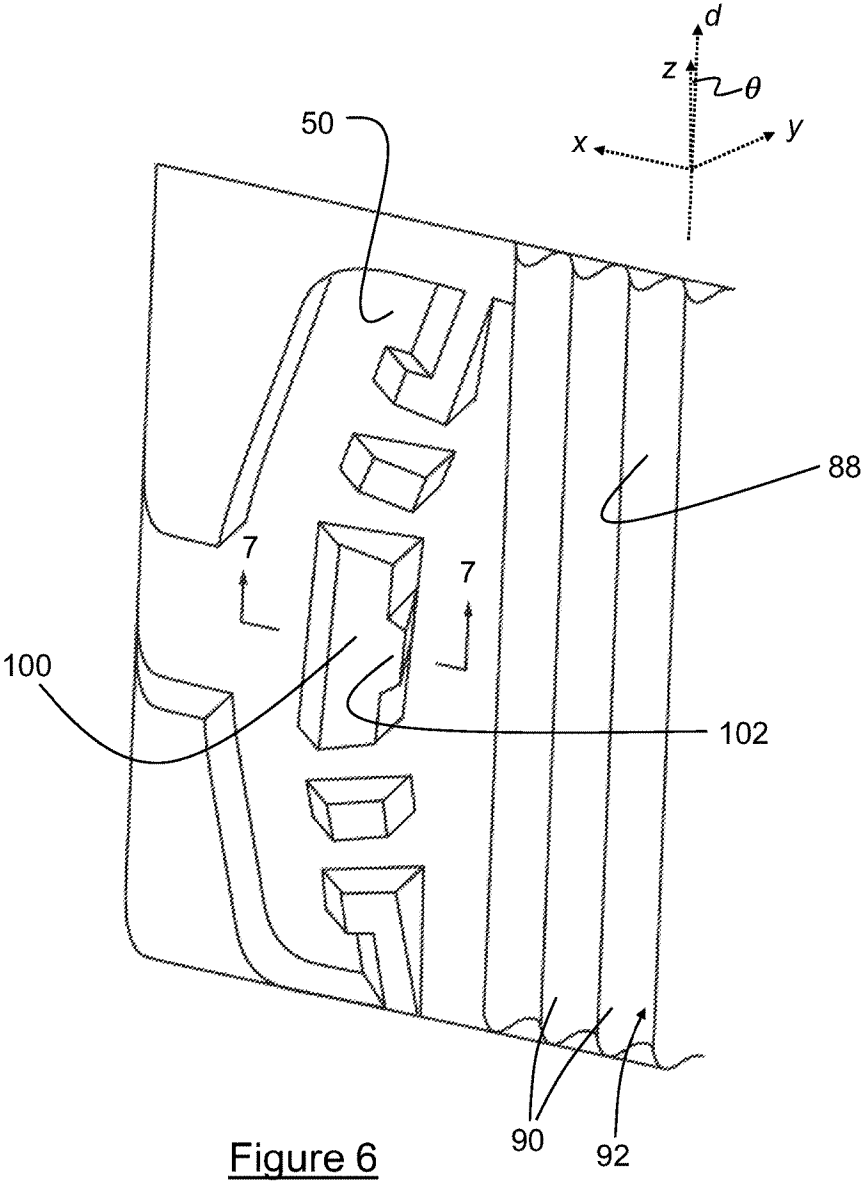
FIG. 6 is an enlarged fragmentary view of another portion of the cover die half of FIG. 5.
Figure 8:
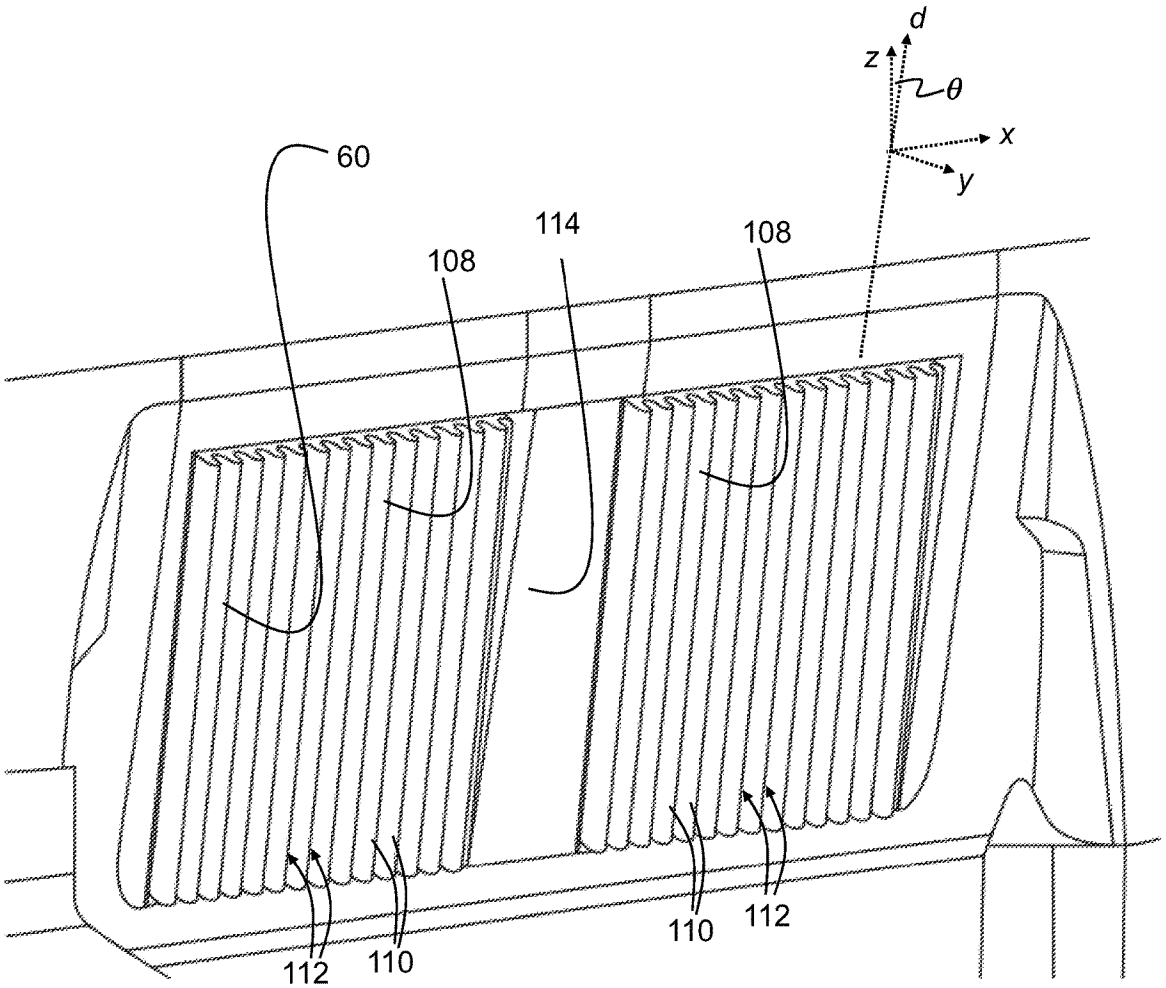
FIG. 8 is an enlarged fragmentary view of a portion of the ejector die half of FIG. 3.

The foregoing summary, as well as the following detailed description of embodiments will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Reference herein to "example" means that one or more feature, structure, element, component, characteristic and/or operational step described in connection with the example is included in at least one embodiment and/or implementation of the subject matter according to the subject disclosure. Thus, the phrases "an example," "another example," and similar language throughout the subject disclosure may, but do not necessarily, refer to the same example. Further, the subject matter characterizing any one example may, but does not necessarily, include the subject matter characterizing any other example.

Unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "affixed" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly affixed" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Reference herein to "configured" denotes an actual state of configuration that fundamentally ties the element or feature to the physical characteristics of the element or feature preceding the phrase "configured to".

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of a lower-numbered item (e.g., a "first" item) and/or a higher-numbered item (e.g., a "third" item).

As used herein, the terms "approximately" and "about" represent an amount close to the stated amount that still performs the desired function or achieves the desired result. For example, the terms "approximately" and "about" may refer to an amount that is within engineering tolerances that would be readily appreciated by a person skilled in the art.

Turning now to FIGS. 1 to 8, a portion of a vacuum-assisted die casting apparatus is shown and is generally indicated by reference numeral 20. Vacuum-assisted die casting apparatus 20 comprises a die assembly 22 having a plurality of moveable dies which, when brought into a closed configuration, define a mold cavity for forming a metal casting. In the example shown, the die assembly 22 is configured to form a casting in the shape of an automotive automatic transmission case, however it will be understood that the die assembly 22 may alternatively be configured to form castings of other shapes.

The die assembly 22 comprises two opposing die halves, namely a moveable ejector die half 26 and a stationary cover die half 28. The ejector die half 26 is coupled to a main actuator (not shown), which is configured to move the ejector die half 26 linearly toward and away from the cover die half 28 along a set of parallel guide rods (not shown). In particular, and with reference to the coordinate axes x, y and z defining the cartesian coordinate space xyz, the ejector die half 26 is configured to be moved by the main actuator in they direction toward the cover die half 28 as the die assembly 22 is brought into the closed configuration, and in the opposite direction (namely, the −y direction) away from the cover die half 28 as the die assembly 22 is brought into an open configuration.

The ejector die half 26 comprises an ejector frame 32 that supports an ejector die 34. The cover die half 28 comprises a cover frame 36 that supports a cover die 38. The ejector die 34 and the cover die 38, when brought together, contact each other along a parting line. With reference again to the coordinate axes defining the cartesian coordinate space xyz used throughout FIGS. 1 to 8, the parting line lies within the xz plane, where the z direction is the vertical direction. As will be understood, the y axis, along which the ejector die half 26 is moved in either the y or −y direction, is perpendicular to the xz plane.

The ejector die 34 has an ejector mold surface 40 that defines a portion of the mold cavity, and a plurality of gate surfaces (not shown) that define gating in portions of the mold cavity. The ejector die 34 also has a plurality of apertures (not shown) accommodating extendible ejector pins (not shown), which are housed in the ejector frame 32 and which are configured to extend to eject the casting from the ejector die 34 after the casting has been formed.

The cover frame 36 is coupled to a shot sleeve 42, which extends through the cover frame 36 to a shot hole 44 formed on the surface of the cover die 38. The shot sleeve 42 is sized to receive a piston (not shown) for pushing a volume of liquid metal into the mold cavity during operation. The cover die 38 has a runner 46 extending generally upwardly from the shot hole 44, a cover mold surface 48 connected to the runner 46, and a cover chill vent surface 50 above the cover mold surface 48. The runner 46, the cover mold surface 48 and the cover chill vent surface 50 all define portions of the mold cavity.

The die assembly 22 also comprises a plurality of moveable slide dies coupled to the ejector die half 26. The moveable slide dies have mold surfaces that define undercut portions of the mold cavity, or in other words, that form undercut surfaces of the casting. In the example shown, the die assembly 22 comprises an upper slide die 56 having an upper mold surface 58 and an ejector chill vent surface 60, a moveable lower slide die 62 having a lower mold surface 64, a moveable left slide die 66 having a generally frusto-conical bell mold surface 68, and a moveable right slide die 72 having an end mold surface 74. In this embodiment, the upper slide die 56, the left slide die 66 and the right slide die 72 also have a plurality of gate surfaces (not shown) that cooperate with the gate surfaces of the ejector die 34 to define the gating in portions of the mold cavity.

Each of the slide dies 56, 62, 66 and 72 is coupled to a respective slide actuator, and is configured to be independently moved by its slide actuator linearly toward or away from the ejector mold surface 40 during operation. In particular, the upper slide die 56 is configured to be moved by its slide actuator in the −z direction toward the ejector mold surface 40, and in the z direction away from the ejector mold surface 40, as the die assembly 22 is brought into the closed and open configurations respectively. The lower slide die 62 is configured to be moved by its slide actuator in the z direction toward the ejector mold surface 40, and in the −z direction away from the ejector mold surface 40, as the die assembly 22 is brought into the closed and open configurations respectively. The left slide die 66 is configured to be moved by its slide actuator in the x direction toward the ejector mold surface 40, and in the −x direction away from the ejector mold surface 40, as the die assembly 22 is brought into the closed and open configurations respectively. The right slide die 72 is configured to be moved by its slide actuator in the −x direction toward the ejector mold surface 40, and in the x direction away from the ejector mold surface 40, as the die assembly 22 is brought into the closed and open configurations respectively.

The cover frame 36 has an upper vacuum port 82 that is coupled to a vacuum source (not shown) via flexible tubing. The vacuum source may be, for example, a vacuum pump. The vacuum port 82 is connected to one (1) or two (2) internal vacuum conduits 84 that extend through the interior of the cover frame 36 to two (2) vacuum apertures 86 formed on the cover chill vent surface 50 of the cover die 38. During operation, the mold cavity is fluidically coupled to the vacuum source via the vacuum port 82, the internal vacuum conduits 84 and the vacuum apertures 86 for enabling vacuum (namely, negative pressure) to be applied to the mold cavity.

As will be understood, the die assembly 22 is configured such that, when the die assembly 22 is in the closed configuration, the ejector chill vent surface 60 and the cover chill vent surface 50 oppose each other in a spaced manner to define a chill vent volume therebetween. As will also be understood, the chill vent volume forms a portion of the mold cavity, and is configured to passively provide a large surface area for solidifying liquid metal flowing therethrough, so as to prevent the liquid metal from otherwise exiting the mold cavity.

The cover chill vent surface 50 comprises two (2) corrugated surfaces 88. Each corrugated surface 88 comprises a plurality of parallel, alternating crests 90 and troughs 92 that extend the height of the corrugated surface 88. In the example shown, the crests 90 and troughs 92 alternate in a generally sinusoidal configuration. The parallel crests 90 of both corrugated surfaces 88 are coplanar, and are inclined from the plane containing the parting line by an angle θ. In particular, each parallel crest 90 extends in a direction d that lies within the yz plane and is inclined from the z axis by the angle θ. In this example, the angle θ has a value of about two (2) degrees. The parallel troughs 92 of both corrugated surfaces 88 are also coplanar, and each parallel trough 92 also extends in the direction d that lies within the yz plane and is inclined from the z axis by the angle θ.

The cover chill vent surface 50 also comprises a recessed, elongate vacuum channel 96 that extends along an interior edge of each corrugated surface 88. Each vacuum channel 96 terminates at a respective vacuum aperture 76 at its upper end.

The cover chill vent surface 50 further comprises a raised fluid baffle 100 comprising a lifter tab 102 having an inclined surface 104 projecting inwardly toward the corrugated surface 88. In particular, the tab 102 is inclined to the plane xd, along which the alternating crests 90 and troughs 92 extend, by an angle α. The lifter tab 102 is shaped to assist in detachment of the casting from the ejector chill vent surface 60 when the ejector die half 26 is pulled away from the stationary cover die half 28 toward the end of the casting cycle. As will be understood, the inclined surface 104 of the lifter tab 102, which is inclined to the plane xd and therefore also partially inclined to the y axis, imparts both a normal movement and transverse movement to the casting relative to the corrugated surface 108 as the ejector die half 26 is pulled in the −y direction away from the cover die half 28 as the die assembly 22 is brought into an open configuration. The combined normal and transverse movements in turn causes the casting to detach from, and thereby become loosely decoupled from, the ejector chill vent surface 60.

The ejector chill vent surface 60 comprises two (2) corrugated surfaces 108. Each corrugated surface 108 comprises a plurality of parallel, alternating crests 110 and troughs 112 that extend the height of the corrugated surface 108. In the example shown, the crests 110 and troughs 112 alternate in a generally sinusoidal configuration. The parallel crests 110 of both corrugated surfaces 108 are coplanar, and are inclined from the plane containing the parting line by the angle θ. In particular, each parallel crest 100 extends in the direction d that lies within the yz plane and is inclined from the z axis by the angle θ. The parallel troughs 112 of the two (2) corrugated surfaces 108 are also coplanar, and each parallel trough 112 extends in the direction d that lies within the yz plane and is inclined from the z axis by the angle θ. The ejector chill vent surface 60 further comprises a planar surface 114 extending between the interior edges of each corrugated surface 108. The planar surface 114 is configured to oppose the elongate vacuum channels 96 formed in the cover chill vent surface 50 when the die assembly 22 is in the closed position.

During use, the die assembly 22 is moved from the open configuration to the closed configuration by activating the slide actuators to: i) lower the upper slide die 56 to its closed position; ii) elevate the lower slide die 62 to its closed position; iii) move the right slide die 72 laterally to its closed position; and iv) move the left slide die 66 laterally to its closed position. With the slide dies in their closed positions, the main actuator is then activated to move the ejector die half 26 toward the cover die half 28, such that surfaces of the ejector die 34, the upper slide die 56, the lower slide die 62, the left slide die 66 and the right slide die 72, are brought into contact with opposing surfaces of the cover die 38. With opposing die surfaces in contact with each other, the die assembly 22 is in the closed configuration and the mold cavity is defined.

Vacuum is applied by the vacuum source to the mold cavity via the vacuum apertures 86, and a volume of liquid metal is pushed by the piston through the shot hole 44 in into the mold cavity. The volume of liquid metal flows upward from the shot hole 44, fills the central portion of the mold cavity defined by the mold surfaces 40, 48, 58, 64, 68 and 74, and continues to flow upward through the gating into the chill vent volume defined between the opposing ejector chill vent surface 60 and cover chill vent surface 50. The liquid metal flows laterally across the opposing corrugated surfaces 88 and 108 toward the elongate vacuum channels 96. Owing to the large surface area of the opposing corrugated surfaces 88 and 108, and owing to the reduction of temperature of the liquid metal as it progresses through the mold cavity, the liquid metal cools and solidifies after traversing only a portion of the chill vent volume and before reaching the vacuum apertures 86. The remainder of the liquid metal then cools and solidifies within the mold cavity, thereby forming the casting.

Once the casting has cooled to a suitable temperature, the die assembly 22 is moved into the open configuration by activating the main actuator to pull the ejector die half 26, with the casting attached thereto, away from the stationary cover die half 28. The slide actuators are then activated to i) move the left slide die 66 laterally in the −x direction to its open position; ii) move the right slide die 72 laterally in the x direction to its open position; iii) elevate the upper slide die 56 to its open position; and iv) lower the lower slide die 62 to its open position.

With the die assembly 22 now in the open configuration, the casting, which is still attached to the ejector die 34, is removed from the die assembly using a suitable extraction apparatus (not shown) while simultaneously extending the plurality of ejector pins (not shown) housed in the ejector frame 32. The extraction apparatus may be, for example, a robotic arm equipped with a robotic pincer. The die surfaces of the die assembly 22 are then sprayed with lubricant using a robotic arm (not shown) equipped with a spray nozzle (not shown) positioned between the ejector die half 26 and the cover die half 28, to prepare the die assembly 22 for the next casting cycle.

Figure 9:
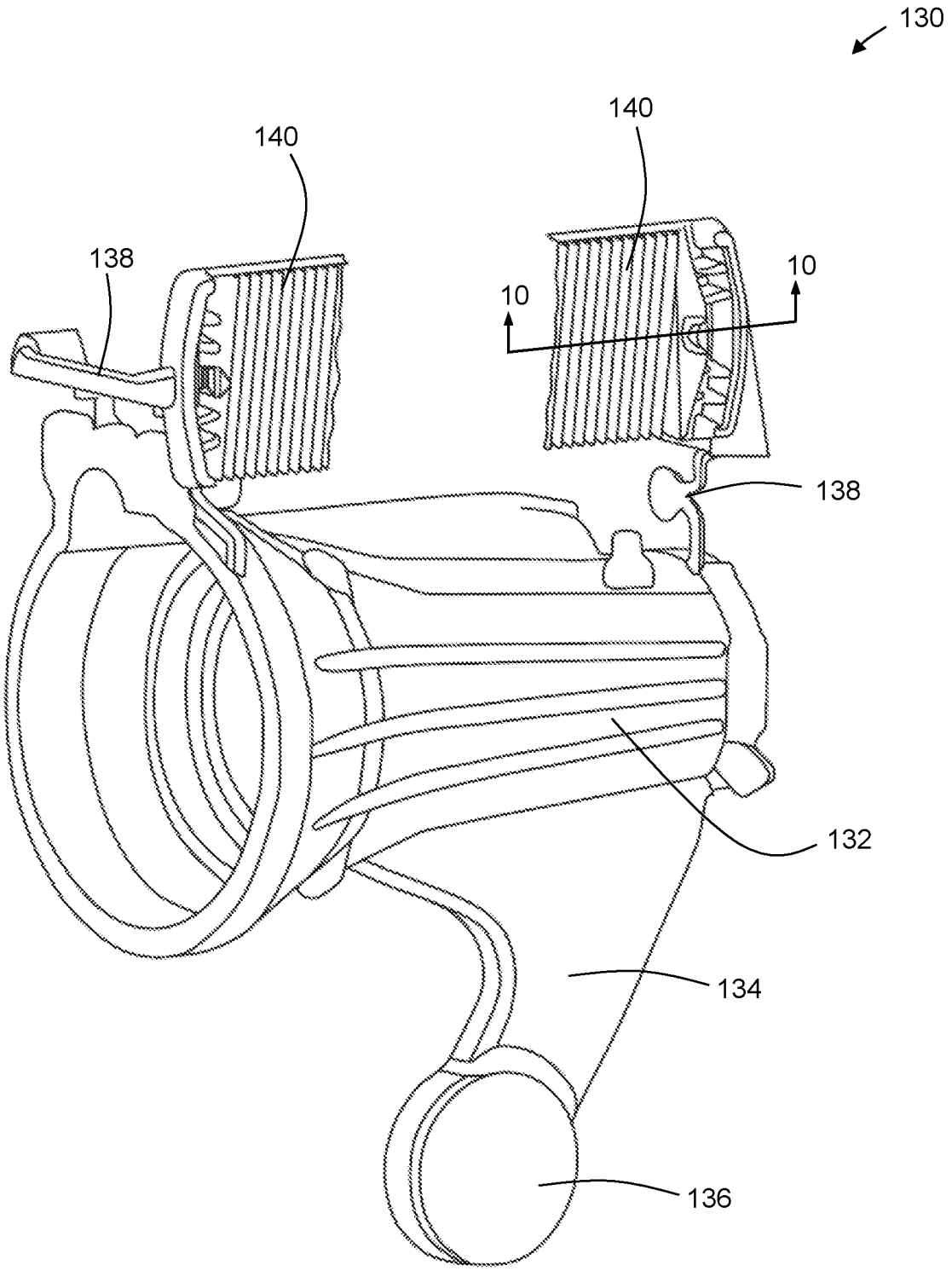
FIG. 9 is a perspective view of a casting fabricated using the die assembly of FIG. 1.
Figure 10:
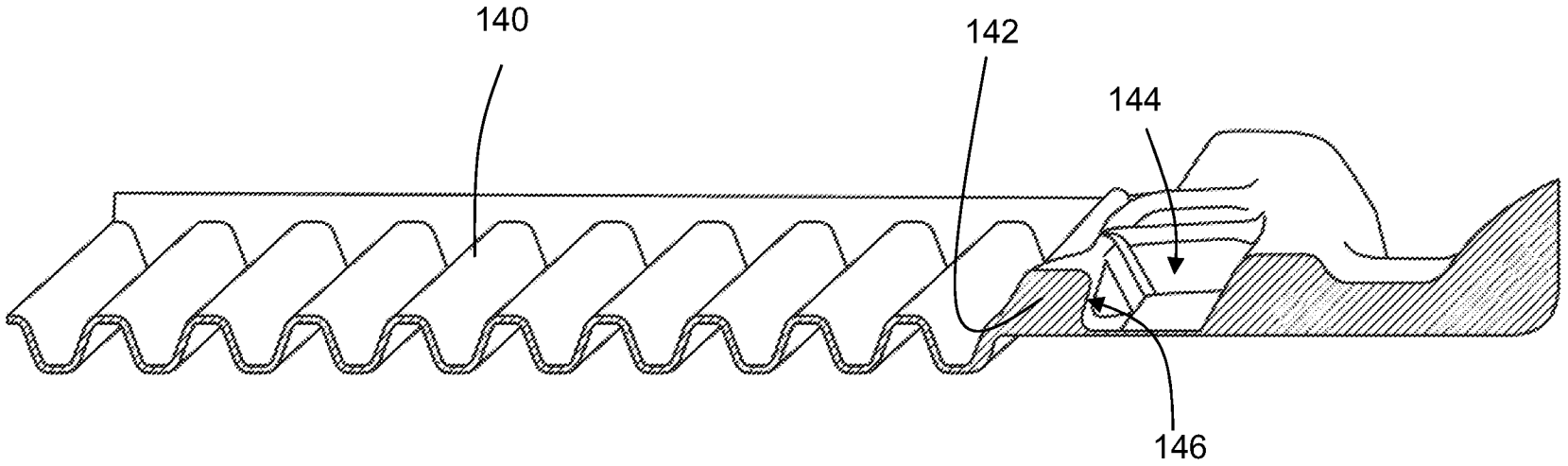
FIG. 10 is a sectional view of a portion of the casting of FIG. 9, taken along the indicated section line.

FIGS. 9 and 10 show a casting formed using the die assembly 22, and which is generally indicated by reference numeral 130. In the example shown, casting 130 is in the shape of an automotive automatic transmission case, and comprises a hollow, elongate transmission case body 132, a runner 134 extending downwardly from the body 132 and terminating at a shot hole disc 136, and two (2) gates 138 extending upwardly from the body 132 and each terminating in a respective chill vent block 140 above the body 132. As shown in FIG. 9, each chill vent block 140 occupies only a portion of the total chill vent volume available.

As shown in FIG. 10, each chill vent block 140 comprises a gating portion 142 defining a lifting tab cavity 144 having an inclined surface 146. As will be understood, the lifting tab cavity 144 having the inclined surface 146 are formed by the lifting tab 102 and inclined surface 104 of the cover chill vent surface 50.

In use, after the casting 130 is removed from the die assembly 22, the body 132 is separated from the runner 134 and from the gates 138 and chill vent blocks 140 by cutting with a suitable tool, such as a saw. The body 132 may then be subjected to additional machining operations, such as grinding, and the like.

As will be appreciated, the positioning of the cover chill vent surface 50 on the cover die 38 centrally above the cover die surface 48, and the positioning of the ejector chill vent surface 60 and on the upper slide die 56, advantageously avoids positioning the chill vent surfaces at upper corners of the ejector die 34 and the cover die 38, as would otherwise be required in conventional die assemblies comprising generic chill vent die inserts. This, in turn, advantageously avoids the unacceptable parting line flashing that would otherwise occur during filling of mold, as a result of the upper corners of the ejector die and cover die becoming spaced apart due to thermal expansion of the intervening slide dies during successive die casting cycles.

As will be appreciated, the orientation of the corrugations of the corrugated surfaces 108 of the ejector chill vent surface 60, and namely the direction d lying within the yz plane, avoids undercut and thereby allows the upper slide die 56 to be drawn freely as the die assembly 22 is brought into the open configuration. As will be understood, this feature advantageously eliminates the need for the upper slide die 56 to contain a separate ejection system. Such a separate ejection system would otherwise require multiple moving parts such as ejector pins to be housed in the upper slide die, which in turn would otherwise increase the cost of the die assembly and increase the likelihood of costly maintenance downtime.

As will be appreciated, the inclusion of the lifter tab 102 on the cover chill vent surface 50 advantageously separates the casting from the ejector chill vent surface 60 as the ejector die half 26 is pulled in the −y direction away from the cover die half 28. As will be understood, separating the casting from the ejector chill vent surface 60 before the upper slide die 56 is drawn (namely, raised) advantageously prevents the casting from sticking to and tearing as the upper slide die 56 is drawn, and thereby avoids costly downtime that would otherwise be required to remove stuck fragments of the casting from the die assembly 22.

Additionally, and as will be appreciated, the inclination the corrugated surface 108, and in particular the inclination of the parallel crests 110 and parallel troughs 112 from the xz plane (namely, the plane containing the parting line) by the angle θ, advantageously allows the upper slide die 56 to be drawn (namely, raised) without interfering with the casting. As will be understood, avoiding inference of the movement of the upper slide die 56 by the casting allows the upper slide die 56 to more easily be drawn and reduces the likelihood of portions of the casting becoming torn, which avoids costly downtime that would otherwise be required to remove torn fragments of the casting from the die assembly 22.

As will be appreciated, the corrugated shape of the corrugated surfaces 88 and 108 increase the length of travel of the liquid metal. As will be understood, the increased length of the travel advantageously increases the ratio of the flow length to the projected area of the chill vent volume, which eliminates the need to otherwise widen the upper slide die in order to accommodate a longer chill surface. As a result, the size of the upper slide die 56 can advantageously be minimized.

In other embodiments, the die assembly 22 may be differently configured. For example, although in the embodiment described above, the angle θ has a value of about two (2) degrees, in other embodiments, the angle θ may alternatively have another suitable, non-zero value. For example, in other embodiments, the angle θ may alternatively have a value of between 0.1 and 20 degrees.

Although in the embodiment described above, each of the cover chill vent surface 50 and the ejector chill vent surface 60 comprises two (2) corrugated surfaces that each comprise a plurality of parallel, alternating crests and troughs that alternate in a generally sinusoidal configuration, in other embodiments, the cover chill vent surface and the ejector chill vent surface may alternatively comprise two (2) corrugated surfaces that each comprise a plurality of parallel, alternating crests and troughs that alternate in another configuration. For example, in some embodiments, the corrugated surfaces may alternatively comprise a plurality of parallel, alternating crests and troughs that alternate in a sawtooth configuration, a "rounded" square configuration, a triangle configuration, and the like. It will be understood that still other, non-periodic configurations may alternatively be used, provided the cover chill vent surface and the ejector chill vent surface cooperate in a complimentary way in the manner described in the embodiment described above Although embodiments have been described above with reference to the accompanying drawings, those of skill in the art will appreciate that variations and modifications may be made without departing from the scope thereof as defined by the appended claims.

What is claimed is:

1. A die assembly for a vacuum assisted die casting apparatus, the die assembly comprising:

a cover die half supporting a cover die, the cover die having a first chill vent surface;

a moveable ejector die half supporting an ejector die, the ejector die half being configured to be moved along a first axis; and a moveable slide die supported by the ejector die, the slide die being configured to be moved along a second axis perpendicular to the first axis, the slide die having a second chill vent surface.

2. The die assembly of claim 1, wherein the first chill vent surface defines a plurality of parallel, first elongate features, and the second chill vent surface defines a plurality of parallel, second elongate features, and the first elongate features are parallel to the second elongate features.

3. The die assembly of claim 2, wherein the first elongate features and the second elongate features extend in a direction that lies within a plane defined by the first axis and the second axis.

4. The die assembly of claim 3, wherein the first chill vent surface comprises an inclined tab shaped to pull and detach a casting from the second chill vent surface when the moveable ejector die half is drawn along the first axis.

5. The die assembly of claim 4, wherein the inclined tab has an inclined surface defining an inclination plane, said direction that lies within the plane defined by the first axis and the second axis also lying within the inclination plane.

6. The die assembly of claim 3, wherein the direction defines an angle with the second axis of between 0.1 and 20 degrees.

7. The die assembly of claim 1, wherein the first chill vent surface comprises a first corrugated surface, and the second chill vent surface comprises a second corrugated surface.

8. The die assembly of claim 7, wherein the first corrugated surface comprises a plurality of first corrugations, and the second corrugated surface comprises a plurality of second corrugations, the first corrugations being parallel to the second corrugations.

9. The die assembly of claim 8, wherein the first corrugations and the second corrugations extend in a direction that lies within a plane defined by the first axis and the second axis.

10. The die assembly of claim 9, wherein the first chill vent surface comprises an inclined tab shaped to pull and detach a casting from the second chill vent surface when the moveable ejector die half is drawn along the first axis.

11. The die assembly of claim 10, wherein the inclined tab has an inclined surface defining an inclination plane, said direction that lies within the plane defined by the first axis and the second axis also lying within the inclination plane.

12. The die assembly of claim 9, wherein the direction defines an angle with the second axis of between 0.1 and 20 degrees.

13. The die assembly of claim 8, wherein the first corrugations comprise a plurality of crests and troughs that alternate periodically.

14. The die assembly of claim 13, wherein the crests and troughs alternate sinusoidally.

15. The die assembly of claim 8, wherein the second corrugations comprise a plurality of crests and troughs that alternate periodically.

16. The die assembly of claim 15, wherein the crests and troughs alternate sinusoidally.

* * * * *